US009371163B2

(12) United States Patent
Frolin

(10) Patent No.: US 9,371,163 B2
(45) Date of Patent: Jun. 21, 2016

(54) CONTAINER, IN PARTICULAR FOR FOOD USE

(71) Applicant: NEOLID, Lyons (FR)

(72) Inventor: Nicolas Frolin, Lyons (FR)

(73) Assignee: NEOLID, Lyons (FR)

( * ) Notice: Subject to any disclaimer, the term of this patent is extended or adjusted under 35 U.S.C. 154(b) by 33 days.

(21) Appl. No.: 14/378,058

(22) PCT Filed: Mar. 11, 2013

(86) PCT No.: PCT/IB2013/051914
§ 371 (c)(1),
(2) Date: Aug. 11, 2014

(87) PCT Pub. No.: WO2013/136253
PCT Pub. Date: Sep. 19, 2013

(65) Prior Publication Data

US 2015/0034650 A1 Feb. 5, 2015

(30) Foreign Application Priority Data

Mar. 16, 2012 (FR) ..... 12 52375

(51) Int. Cl.
*B65D 53/00* (2006.01)
*B65D 47/20* (2006.01)
*B65D 51/00* (2006.01)

(52) U.S. Cl.
CPC ..... *B65D 47/2025* (2013.01); *B65D 47/2018* (2013.01); *B65D 51/00* (2013.01)

(58) Field of Classification Search
CPC ..... B65D 47/205; B65D 5/0218; B65D 47/2043; B65D 51/00; B65D 47/2031; B65D 47/2025; B65D 47/2037
USPC ..... 220/281; 215/313, 314
See application file for complete search history.

(56) References Cited

U.S. PATENT DOCUMENTS 1,431,918 A * 10/1922 Arthur ..... A45C 13/10 222/507
2,474,120 A * 6/1949 Rumsey, Jr. ..... B65D 35/44 206/525
3,556,390 A * 1/1971 Gould ..... B65D 75/16 206/272
5,165,593 A * 11/1992 Chuang ..... B65D 5/0218 229/129
2005/0082248 A1 4/2005 Al-Jadda

FOREIGN PATENT DOCUMENTS

FR 2922195 4/2009

* cited by examiner

*Primary Examiner* — Jeffrey Allen
(74) *Attorney, Agent, or Firm* — Defillo & Associates, Inc; Evelyn A. Defillo

(57) ABSTRACT

The invention relates to a container (1) which includes a body (2) forming an opening, a mobile ring (4) capable of pivoting relative to said body (2), and a seal (3) made of a flexible, resilient material, connected to said body (2) as well as to said ring (4), capable of being twisted by pivoting the ring (4). According to the invention, said body (2) includes a circular peripheral wall (10) ending in a free edge that defines said opening, and said ring (4) is intended for being positioned around said wall (10); and one of said peripheral wall (10) or said ring (4) includes a series of grooves (11 and 15) and the other one of said ring (4) or said peripheral wall (10) includes a lug, the movement of said lug in said series of grooves enabling guided axial movement of the ring (4) relative to the wall (10) when the seal (3) starts to twist.

10 Claims, 8 Drawing Sheets

CONTAINER, IN PARTICULAR FOR FOOD USE

CROSS REFERENCE TO RELATED APPLICATION

This application is a national stage entry of PCT/IB2013/051914 filed Mar. 11, 2013, under the International Convention claiming priority over French Application No. 1252375 filed Mar. 16, 2012.

TECHNICAL FIELD

The present invention relates to a container, in particular for food use.

BACKGROUND OF THE INVENTION

It is known, in particular from document FR 2,922,195 in the same applicant's name, to produce a container comprising a sleeve forming a seal for closing off/freeing the opening of the container. This seal, which is connected to the body of the container and to a ring pivoting relative to that body, is made from a flexible resilient material, and can be deformed by twisting between a twisted state, in which it closes off the opening of the container, and a non-twisted state, in which it frees that opening.

The existing containers are not fully satisfactory regarding their handling or the possibilities they offer for closing off/releasing said opening.

Additionally, the existing containers have the particular drawback that, when the product contained in the container has been poured from the container, product remains present on the outer surface of the membrane formed by the seal in the twisted state thereof.

Document Nr. US 2005/082248 A1 illustrates another known container, of the same type with a twisting seal, and comprising notches for immobilizing the ring in a given angular position.

OBJECT OF THE INVENTION

The present invention aims to resolve all of the aforementioned drawbacks.

SUMMARY OF THE INVENTION

The container in question comprises:

a container body forming an opening, a moving ring capable of pivoting relative to the container body, between a position freeing the opening and a position closing off the opening, and a sleeve forming a seal, hereinafter "seal", made from a flexible resilient material, connected to said body on the one hand and to said ring on the other hand, able to be twisted by pivoting the ring relative to the body between said released and closed off positions, the deformation of the seal occurring between a non-twisted state, in which the seal frees the opening of the container, and a twisted state, in which said seal closes off that opening;

said body comprises a circular peripheral wall ending with a free edge that delimits said opening, and said ring is designed to be engaged around that wall;

one from among said peripheral wall and said ring comprises:

an oblique groove, a first end of which is situated at a first axial distance from said opening and a second end of which is situated at a second axial distance from said opening;

a circumferential groove, one end of which communicates with said second end of said oblique groove; and a plurality of notches formed along said circumferential groove, laterally relative to said groove and communicating therewith;

the other from among said peripheral wall and said ring comprises a lug capable of being engaged and sliding in said oblique groove and in said circumferential groove, and capable of partially engaging in one or the other of said notches of said plurality of notches, said oblique groove being positioned such that the movement of said lug therein produces an axial movement of the ring in the direction bringing the ring and said opening axially closer together during a first part of the movement of the ring from said released position to said closing off position, and, conversely, such that said movement produces an axial movement of the ring in the axial separation direction of the ring and said opening during a second part of the movement of the ring from said closing off position to said released position, at least a first of said notches being angularly positioned so as to receive said lug when the seal is in a partial twisted state, and a second of said notches being positioned angularly so as to receive said lug when the seal is in a complete twisted state.

The invention thus consists of providing for guided mobility of the ring relative to said peripheral wall, done by the guiding of said lug in said grooves, then in one or the other of said notches.

In said released position, the ring is in an axially distant position relative to said opening and the seal forms a first part extending along the inner surface of said peripheral wall, an intermediate part surrounding said free edge, and a second part extending along the outer surface of the peripheral wall, said second part being connected to the ring. In this released position, when the product contained in the container is poured outside the container, that product flows along said first part and said intermediate part of the seal, but not over said second part of the seal.

The movement of the ring toward the closing off position from that released position causes the lug to move in the oblique groove, which causes the aforementioned axial movement of the ring closer to the opening, at the same time that the twisting of the seal begins. This axial movement causes said first part and said intermediate part of the seal to retract toward the inside of the container body, such that a remnant of the product present on that first part and that intermediate part is located below the zone of the seal designed to be twisted during sealing. The subsequent movement of the lug in said circumferential groove next causes a guided pivoting movement of the ring relative to the peripheral wall, which continues the twisting of the seal. Next, the engagement of the lug in either of the aforementioned notches, and the maintenance of that lug in that notch, done by the axial resilient return effect exerted on the ring by the twisted seal, makes it possible to keep the ring in the selected angular position, for partial or total sealing of the container.

After sealing, the rest of the aforementioned product is located on the inner surface of the membrane formed by said twisted seal, and no product is present on the outer surface of that membrane.

The release movement of the opening of the container from said closing off position is done following a reverse sequence from that outlined above.

The container may comprise only one lug and a single set of grooves as cited above; preferably, however, the container comprises two angularly opposite lugs and two sets of grooves, angularly opposite in a corresponding manner.

Perfect guiding of the ring is thus obtained.

The container body could then comprise either both lugs, or both sets of grooves, and the ring could respectively comprise either both sets of grooves or both lugs; preferably, however, in order to obtain a small bulk, the container body comprises a first lug and a first set of grooves as previously cited, while the ring comprises a second set of grooves, designed to receive said first lug, as well as a second lug designed to be engaged in said first set of grooves.

Preferably, the ring has a height (i.e., a dimension in the axial direction) smaller than the height of said peripheral wall; said second set of grooves then does not comprise a circumferential groove, but only an oblique groove, and said first lug escapes from said second set of grooves at the end of the axial movement by which the ring come closer to said opening. The pivoting of the ring is guided only by the movement of the second lug in said circumferential groove, which is not particularly bothersome in practice.

Preferably, the circumferential groove comprises at least two notches positioned angularly so as to receive said lug when the seal is in a partially twisted state, namely:

one notch located in a position corresponding to a half-sealing of the opening of the container, allowing a sufficient opening to remain so as to allow a product contained in the container to be cooked, for example in a microwave oven, that position therefore being called "cooking position";

at least one notch positioned on the side of the notch corresponding to the completely sealed position of the opening, allowing an opening to remain just sufficient for the passage of a beverage straw, that position therefore being called "straw" position.

Preferably, each set of grooves comprises an inlet, emerging at the free edge of the peripheral wall or a free edge of the ring, communicating with said first end of said oblique groove.

This inlet facilitates the engagement of the lug in said set of grooves.

To avoid untimely engagement of the lug in said inlet during use of the container, and therefore to keep the lug in said set of grooves, each set of grooves comprises a step, or other type of hard spot, between said oblique groove and said inlet, which must be crossed by the lug to go from said oblique groove to said inlet.

Preferably, said inlet has a width that increases toward said free edge.

The walls forming the side edges of said groove make it possible to guide the return of the lug in said oblique groove and consequently facilitate that return.

Preferably, each set of grooves further comprises:

an intermediate groove, situated between said oblique groove and said inlet, communicating with each of the latter; and a groove for disengagement of the ring with respect to the container body, communicating with that intermediate groove and which emerges in said free edge.

The engagement of the lug in that disengaging groove allows movement of the ring by pivoting beyond said opening position, with twisting of the seal, and axial movement of said ring along said peripheral wall, until it is past the opening of the container. This movement makes it possible to free the ring relative to said wall by elongating the seal, and therefore to perform easy cleaning of the container; the freed position of the ring is therefore called "cleaning position".

To avoid untimely engagement of the lug in said disengaging groove during use of the container, said intermediate groove communicates with that disengaging groove by a step, or other type of hard spot, that must be crossed by the lug to go from said intermediate groove to said disengaging groove.

To facilitate this cleaning, said peripheral wall advantageously comprises wide openings providing access to the outer surface of the seal.

BRIEF DESCRIPTION OF THE DRAWINGS

The invention will be well understood, and other features and advantages thereof will appear, in reference to the appended diagrammatic drawing, showing, as a non-limiting example, two possible embodiments of the container in question.

FIGS. 3 to 23 are various views of the container according to this first embodiment; among which:

FIG. 3 is a partial side view of the container in said freed state;

FIG. 4 is a top view, in that same freed state;

FIG. 5 is a developed view of a set of grooves comprised by the container and a lug also comprised by the container, in the position occupied by that lug in said freed state;

FIG. 6 is an enlarged side view of the container, in cross-section along line VI-VI of FIG. 4;

FIGS. 7 to 10 are views of the container similar to FIGS. 3 to 6, respectively, in a first intermediate position closing off the opening comprised by the container, called "cooking position";

FIGS. 11 to 14 are views of the container similar to FIGS. 3 to 6, respectively, in a second intermediate position closing off the opening comprised by that container, called "straw position";

FIGS. 15 to 18 are views of the container similar to FIGS. 3 to 6, respectively, in the position completely closing off the opening comprised by that container;

FIGS. 19 to 22 are views of the container respectively similar to FIGS. 3 to 6, in a position releasing a ring comprised by the container, called "cleaning position";

FIG. 23 is a cross-sectional view of an outer ring comprised by the container;

FIGS. 25 to 27 are various views of the container according to the second embodiment; among which:

FIG. 25 is an exploded view of the container, similar to FIG. 2;

FIG. 26 is a developed view of the set of grooves comprised by the container and a lug also comprised by that container, in the position occupied by that lug in said freed state;

FIG. 27 is a view of said set of grooves and said lug similar to FIG. 26, in the position completely closing off the opening comprised by that container.

DESCRIPTION OF THE PREFERRED EMBODIMENTS

Figure 1:
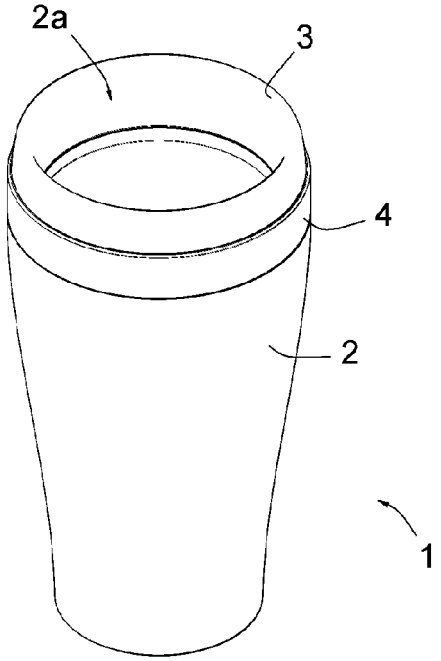
FIG. 1 is a perspective view, in a freed state of the opening that it comprises.

FIG. 1 shows a container 1, in particular for food use, comprising a container body 2 forming an upper opening 2*a*, a sleeve forming a seal 3 (hereinafter "seal") made from a flexible resilient material, and a movable ring 4 able to pivot and move axially relative to said body 2, said seal 3 being connected to the body 2 on the one hand and to the ring 4 on the other hand. As shown in FIGS. 3 to 18, the seal 3 is able to be twisted by pivoting the ring 4 relative to the body 2, that deformation occurring between an untwisted state (see FIGS. 3 to 6), in which the seal 3 completely frees the opening 2*a*, and a complete twisted state (see FIGS. 15 to 18), in which that seal 3 completely closes off that opening 2*a*.

The ring 4 can also be placed and maintained in an intermediate closing off position called "cooking position" (see FIGS. 7 to 10) and in an intermediate closed off position called "straw position" (see FIGS. 11 to 14).

The ring 4 can further be placed in a raised released position, called "cleaning position" (see FIGS. 19 to 22).

Figure 2:
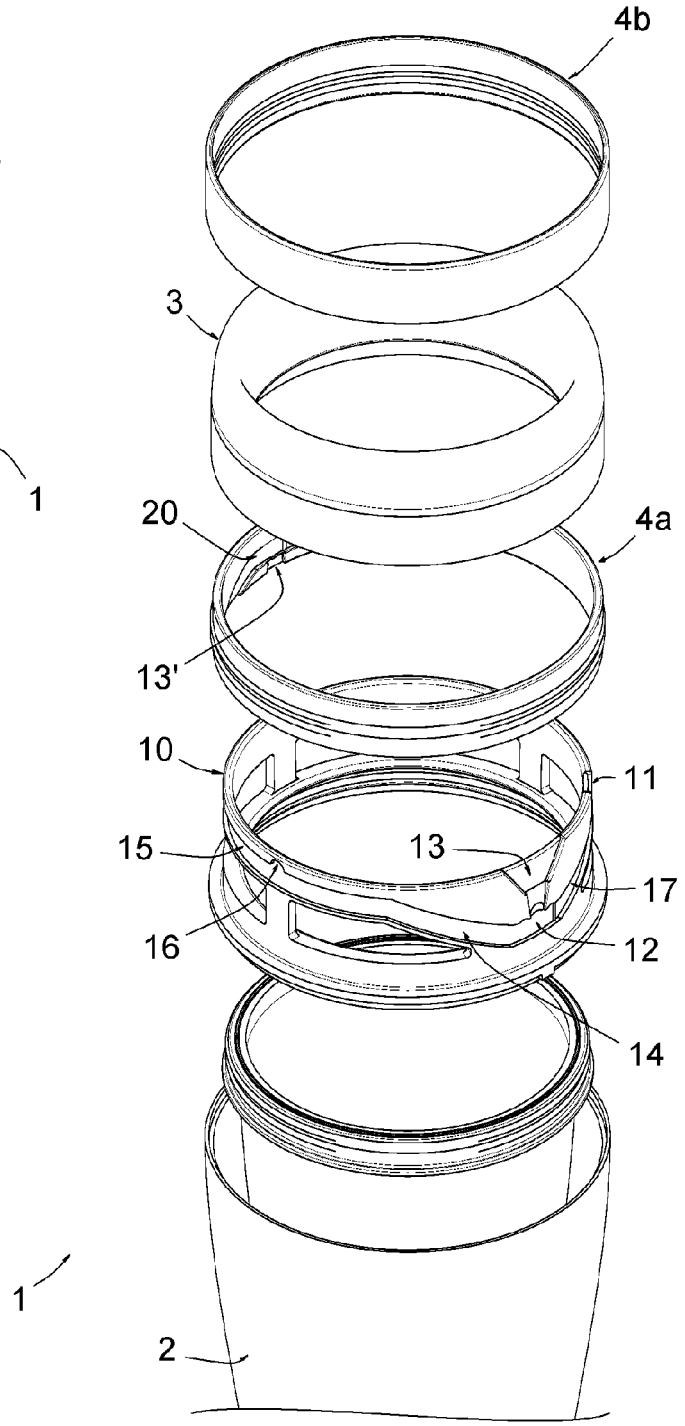
FIG. 2 is a partial perspective view, exploded and enlarged, according to a first embodiment.
Figure 3:
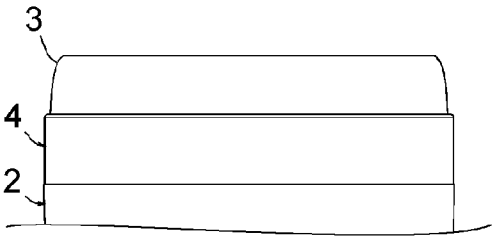
Figure 4:
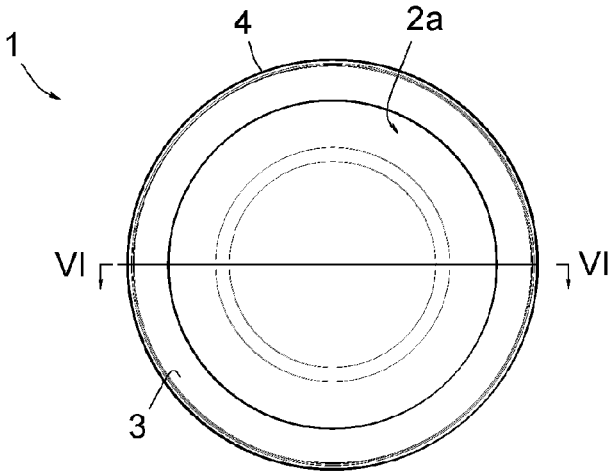
Figure 6:
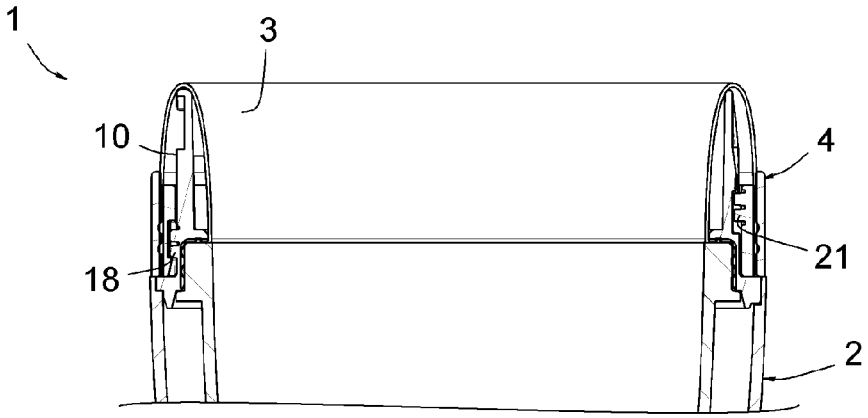
Figure 7:
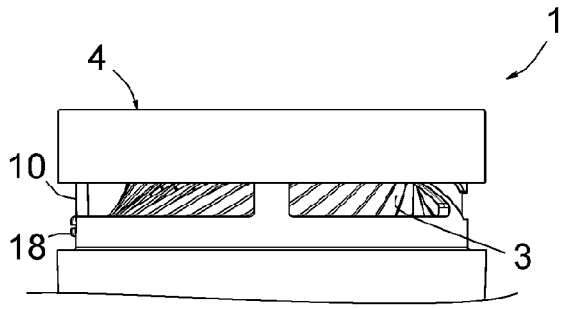
Figure 8:
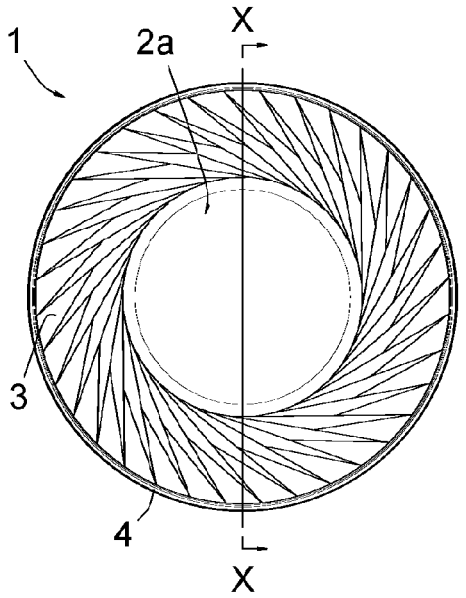

As shown more particularly by FIGS. 2 and 6, in the illustrated example, the container 1 is formed by the assembly of an inner cup and an outer cup, such that it has double walls. The free upper edges of these inner and outer cups jointly form a seat receiving a circular peripheral wall 10, ending with a free edge that delimits the opening 2*a*.

This wall 10 comprises a set of grooves arranged in hollows in its wall, from its outer face, extending from right to left in FIG. 2, that set being formed by an inlet 13, an intermediate groove 12, a disengaging groove 17, 11, an oblique groove 14, a circumferential groove 15, and a plurality of notches 16 arranged along said circumferential groove 15.

Figure 5:
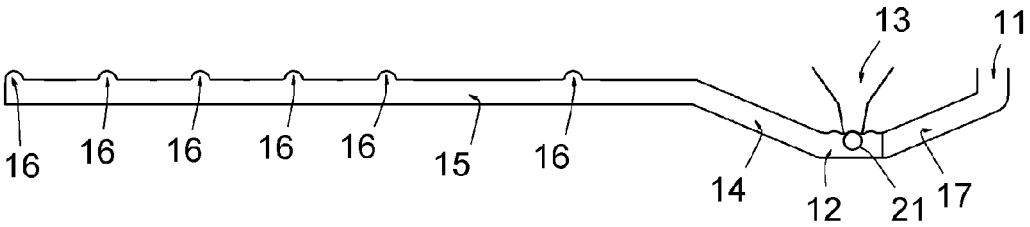

This set is shown developed in FIG. 5.

The inlet 13 emerges in the free upper edge of the wall 10 and communicates with the intermediate groove 12 in a location axially remote from that free edge. It has a shape expanding from its communication with the groove 12 and toward that free edge. As shown in FIG. 2, a level difference further exists between the bottom of the inlet 13 and the deeper bottom of the groove 12, forming a step.

The intermediate groove 12 communicates with the disengaging groove 17, 11, which comprises an oblique groove 17 communicating with the intermediate groove 12 at a location remote from said free edge, and an axial groove 11 emerges in that free edge. A level difference exists between the bottom of the groove 17 and the deeper bottom of the groove 12, thereby forming a step.

The groove 12 also communicates with the oblique groove 14, on its longitudinal side opposite the groove 17.

The oblique groove 14 communicates by a first end with the groove 12, in a first location situated at a first axial distance from said opening 2*a*. It communicates by a second end with the circumferential groove 15, in a second location located at a second axial distance from the opening 2*a*, smaller than said first axial distance.

The circumferential groove 15 communicates with the groove 14 and extends over a wide portion of the circumference of the wall 10.

Figure 9:
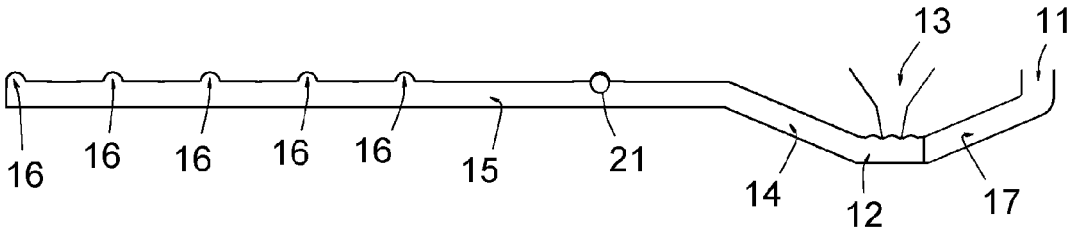
Figure 10:
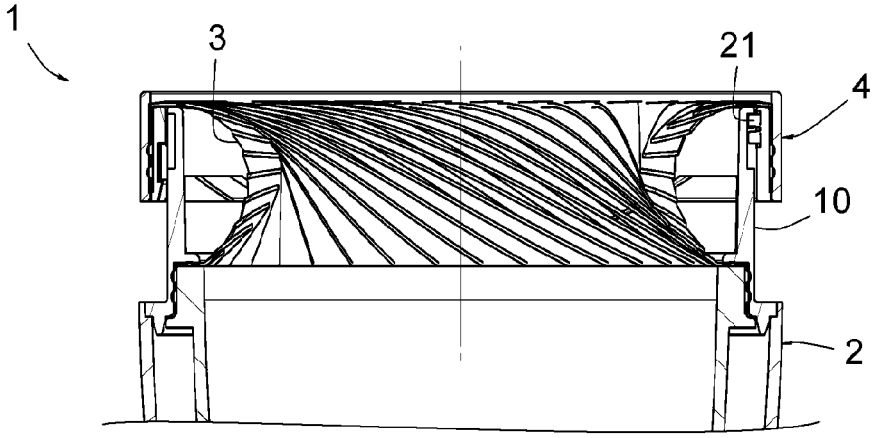
Figure 11:
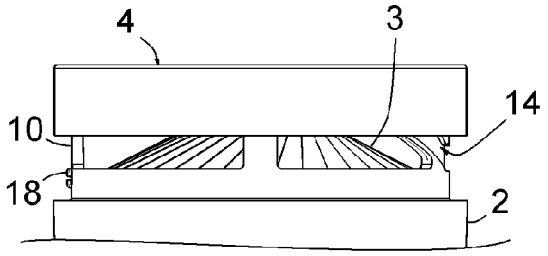
Figure 12:
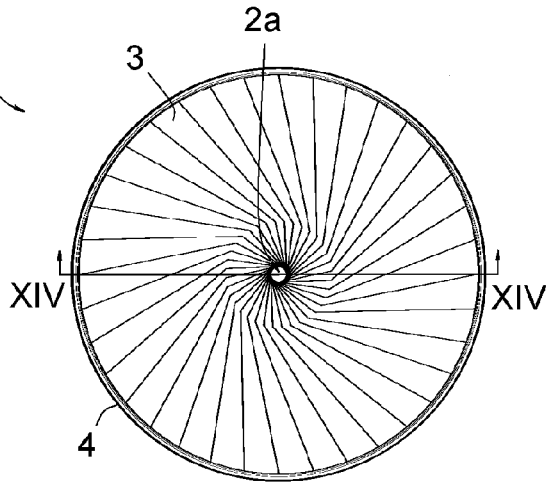
Figure 13:
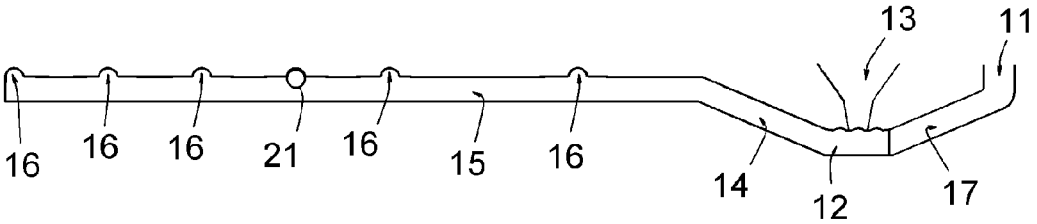
Figure 14:
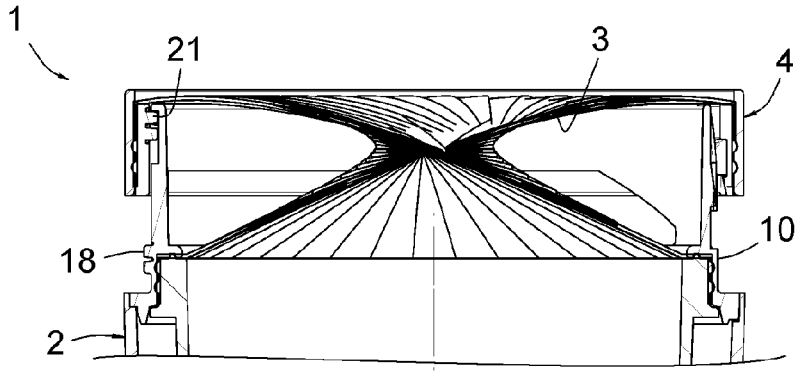
Figure 15:
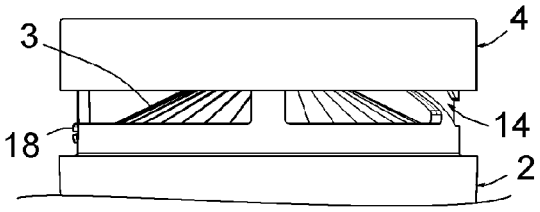
Figure 16:
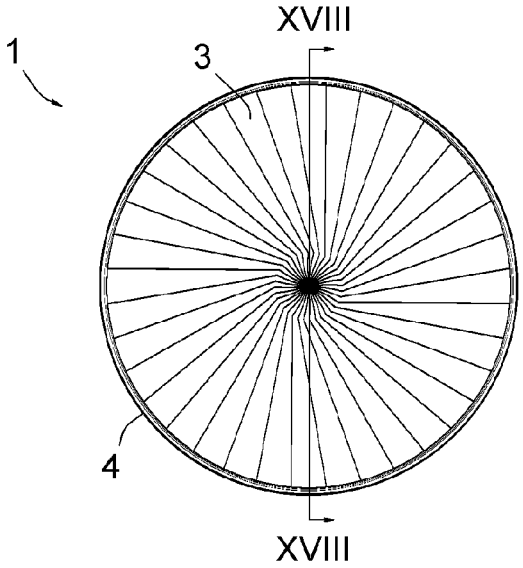
Figure 17:
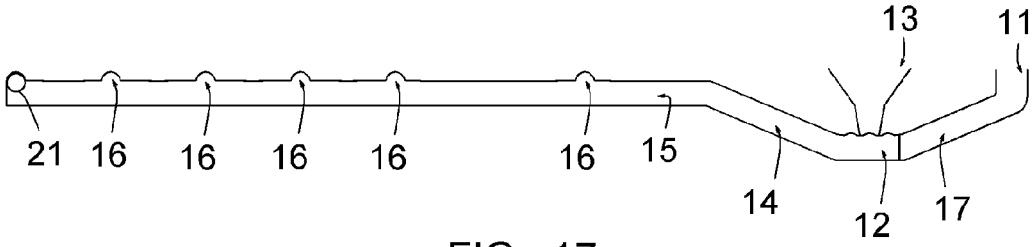
Figure 18:
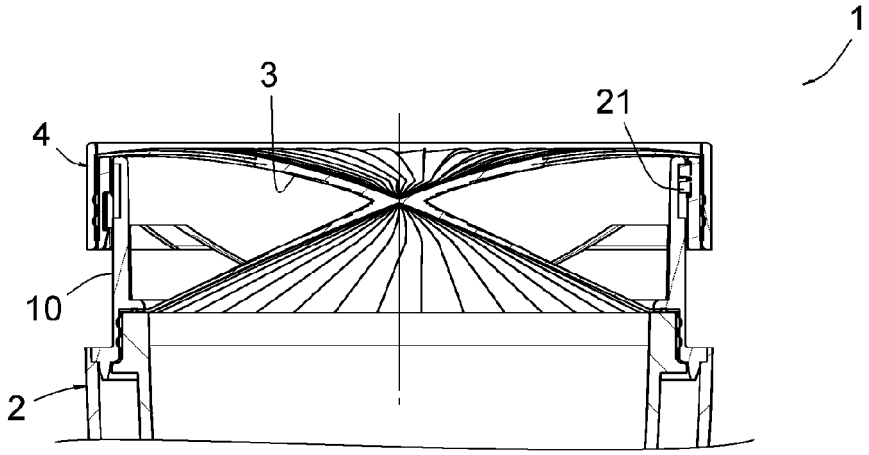
Figure 19:
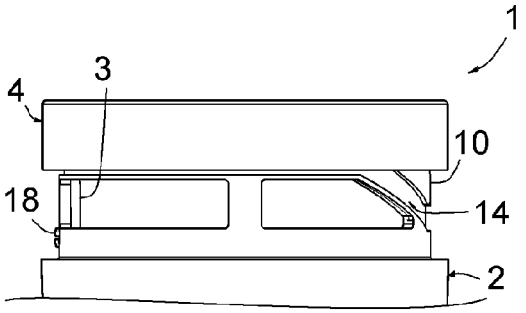
Figure 20:
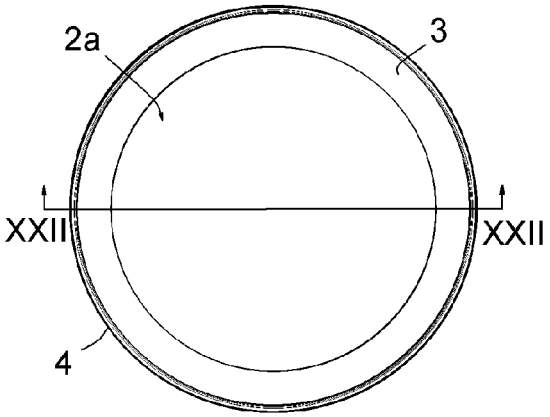
Figure 21:
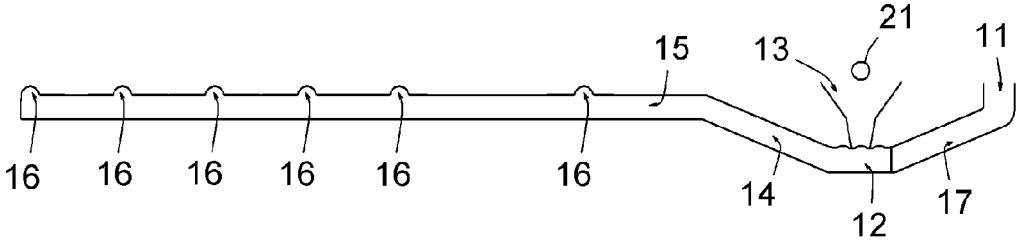
Figure 22:
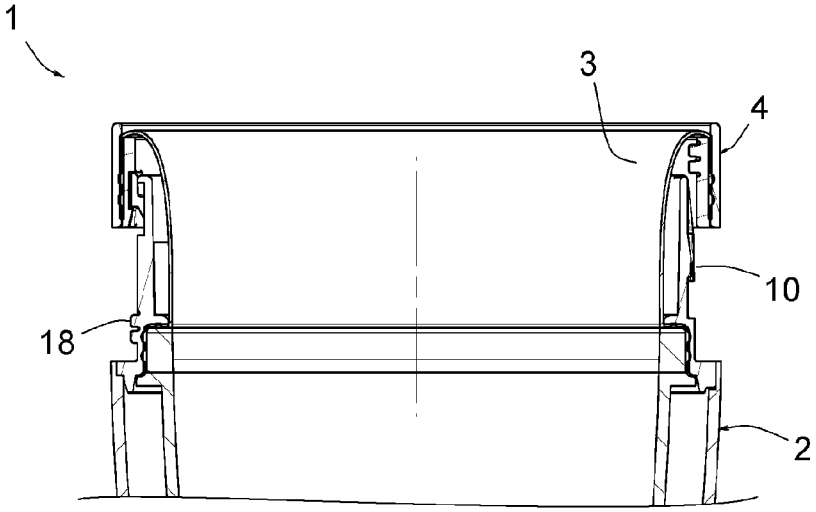

The notches 16 are arranged laterally relative to the groove 15, at the flank thereof closest to said free edge, and communicate therewith. As shown in FIG. 9, the notch 16 closest to the oblique groove 14 receives a lug 21 secured to the ring 4 in said "cooking position" and makes it possible to wedge that ring 4 in that position. As shown in FIG. 13, a notch 16 that is part of a series of four intermediate notches receives the lug 21 in said "straw position" and makes it possible to wedge the ring 4 in that position, with sealing of the membrane formed by the seal 3 around that straw; these four intermediate notches 16 make it possible to obtain several diameters, adapted to different straw diameters. As shown in FIG. 17, the notch 16 located at the end of the groove 15 opposite the oblique groove 14 receives the lug 21 in the complete closing off position and makes it possible to wedge the ring 4 in that position.

Aside from said hollow assembly described above, the wall 10 also comprises a lug 18, shown in FIG. 6, protruding radially outward from that wall 10 and situated diametrically opposite the inlet 13.

The wall 10 further comprises a lower edge forming an assembly seat complementary to that formed by said cups of the body 2, as well as wide cleaning openings, which cross through it.

The seal 3 is connected to the body 2 by imprisoning one of its axial ends between the aforementioned inner cup and the lower part of the wall 10, as shown in FIG. 6. In said position freeing the opening 2*a* shown by FIG. 6, the seal 3 has a first part extending along the inner surface of said wall 10, an intermediate part surrounding the free edge of that wall 10, and a second part extending along the outer surface of the wall 10, said second part being connected to the ring 4.

The ring 4 has a height (i.e., a dimension in the axial direction) smaller than the height of the peripheral wall 10. It is formed by the assembly of an inner ring 4*a* and an outer ring 4*b* imprisoning the second axial end of the seal 3 between them.

Figure 23:
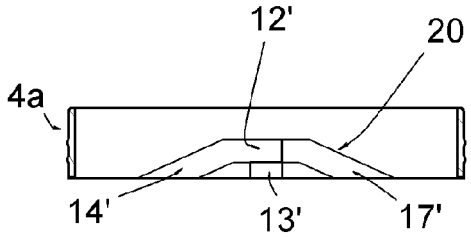
Figure 24:
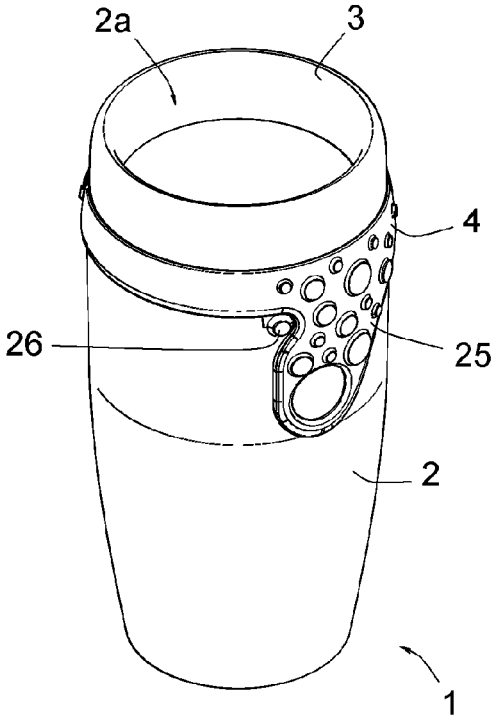
FIG. 24 is a view of the container similar to FIG. 1, according to the second embodiment.
Figure 25:
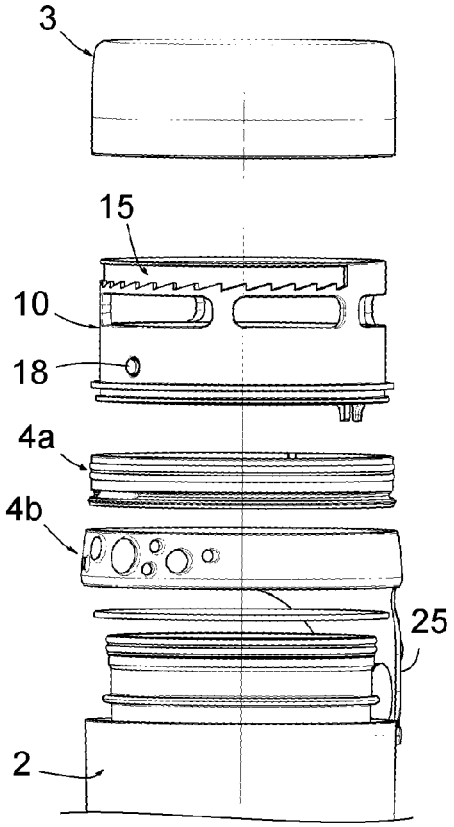

As shown by FIGS. 2 and 23, the inner ring 4*a* comprises a set 20 of grooves 12', 13', 14' and 17' arranged in hollows from the inner surface of said inner ring; these grooves have substantially the same structure as the aforementioned grooves 12, 13, 14 and 17, but the set 20 is reversed relative to the set described above, with the inlet 13' and the disengaging groove 17' of that set 20 emerging in the free lower edge of the inner ring 4*a*. The grooves 14' and 17' have a length smaller than that of the grooves 14 and 17 due to the aforementioned lower height of the ring 4 relative to the wall 10, and the lug 18, which moves in that set 20 during the axial movement of the ring 4, escapes from the set 20 at the end of the axial movement by which the ring 4 approaches said opening 2*a*.

As shown in FIG. 2, the inlet 13' of this set 20 is diametrically opposite the inlet 13 of the wall 10 in said released position shown in that same FIG. 2, in which the seal 3 is not twisted.

The inner ring 4*a* also comprises a lug 21 protruding from its inner surface, radially toward the inside of the ring 4*a*, said lug 21 being situated diametrically opposite the inlet 13' comprised by said set 20. In the released position shown in FIG. 6, said lug 21 is diametrically opposite the lug 18.

As will be understood in reference to the figures, the container 1 is assembled by bringing the lugs 18 and 21 into said inlets 13, 13', then by crossing said steps and arriving in said intermediate grooves 12, 12'. The container 1 is then in the completely released position of the opening 2*a* shown in FIGS. 3 to 6, in which the ring 4 is in an axial position in which it is distant from the free edge of the wall 10, and in which the seal 3 forms said first part, said intermediate part and said second part. In this released position, when the product contained in the container 1 is poured outside the container through the opening 2*a*, that product flows along said first part and said intermediate part of the seal 3, but not over said second part of the seal.

The closing off movement of the container 1 from said released position is done as follows:

movement of the lugs 18 and 21 in the oblique grooves 14, 14', first producing an axial movement of the ring 4 toward the opening 2*a* (see FIGS. 7 to 10), at the same time that the twisting of the seal 3 begins. This axial movement produces a retraction of said first part and said intermediate part of the seal 3 toward the inside of the body 2, such that a remnant of product present on that first part and the intermediate part is brought below the zone of the seal 3 designed to be twisted during closing off;

escape of the lug 18 outside the groove 14' and movement of the lug 21 in the circumferential groove 15, thereby producing a guided pivoting movement of the ring 4 relative to the peripheral wall 10, which continues the twisting of the seal;

engagement of the lug 21 in either of the notches 16 and maintenance of that lug in that notch, that maintenance being done by the axial resilient return force exerted by the seal 3 twisted on the ring 4; this engagement makes it possible to keep the ring 4 in the selected angular position, partially or completely closing off the container 1.

During this partial or total closing off, the aforementioned product remnant is located on the inner surface of the membrane formed by the twisted seal 3, and no product exists on the outer surface of that membrane.

The notch 16 closest to the grooves 14 makes it possible to keep the ring 4 in the "cooking position" shown in FIGS. 7 to 10; one or another of the following four notches 16 makes it possible to keep the ring 4 in the "straw position" shown in FIGS. 11 to 14, with sealed application of the membrane formed by the seal 3 around that straw; the notch 16 situated at the end of the groove 15 makes it possible to keep the ring 4 in the completely closed off position shown in FIGS. 15 to 18.

The release movement of the opening 2*a* from said closing off position is done following a reverse sequence from that described above.

To clean the container 1, the ring 4 being in said freed position, the user exerts a forced pivoting of the ring to cross the steps separating the groove 12, 17 and 12', 17'; the lugs 18, 21 then travel over the release grooves 17, 11, 17', up to the released position shown in FIGS. 19 to 22. This movement of the ring 4 makes it possible to elongate the seal 3 and therefore to perform easier cleaning of the container 1; in this position, the resilient return of the seal 3 to the neutral position makes it possible to bring the lugs 18, 21 back across from the inlet 13, 13'.

Once the cleaning is done, the flared shape of the inlet 13 makes it possible to guide the lug 21 toward the groove 12 and consequently facilitates the return of the two lugs 18, 21 into their respective grooves 12, 12'.

FIGS. 24 to 27 show the second embodiment of the container 1. For simplification reasons, the same numerical references as in the description of the first embodiment will be reused to designate identical or similar elements or parts.

In this case, the groove 15 forms many notches 16, adjacent to one another, each of which is delimited by two wall flanks substantially at a right angle relative to one another. The groove 15 is thus longitudinally delimited by a saw tooth-shaped rim.

The lug 21 has a notch on its side turned toward the notches 16, allowing that lug to be engaged on one or another of the saw teeth formed by said rim. That lug 21 is thus capable of engaging with that rim in many possible angular positions of the ring 4 relative to the wall 10.

Figure 26:
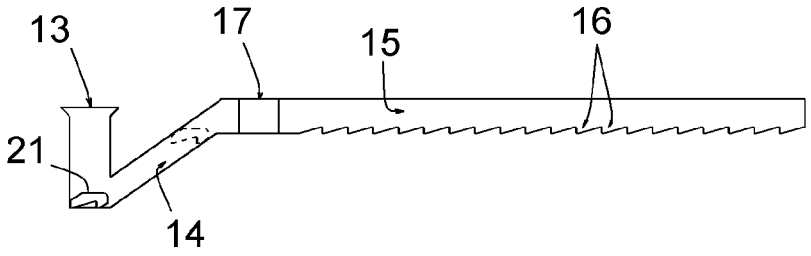

The lug 21 also has two opposite sides shaped obliquely, allowing it to slide in an adjusted manner in the oblique groove 14, as shown by FIG. 26 in broken lines. Perfect guiding of that lug 21 in that oblique groove 14 is thus made possible.

Furthermore, the ring 4 comprises a wall 25 protruding along the container 2, and the latter comprises a boss 26. The wall 25 abuts against that boss 26 in the fully open position of the container 1 (see FIG. 24), which ensures stable angular positioning of the ring 4 in that position relative to the container 2.

Figure 27:
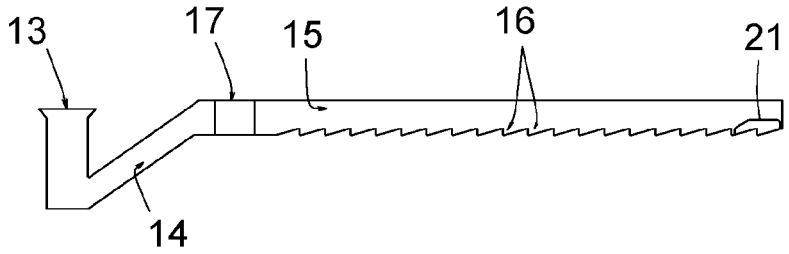
Figure 28:
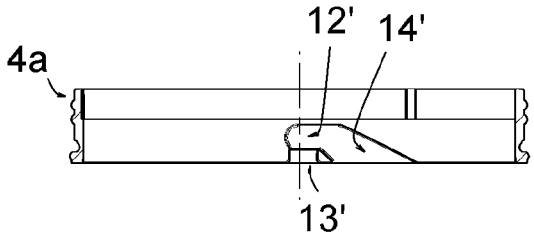
FIG. 28 is a cross-sectional view, similar to FIG. 23, of an outer ring comprised by the container.

FIG. 28 shows the set of grooves 12' and 14' and the inlet 13' diametrically opposite those previously mentioned, like that which was described for the first embodiment. For this second embodiment, it should be noted that the release groove 17 is located between the grooves 14 and 14, as shown in FIGS. 26 and 27.

As shown by the preceding, the invention provides a container, in particular for food use, having the decisive advantages of being fully satisfactory regarding its handling or the possibilities it offers for closing off/freeing its opening, and eliminating any risk of a product remnant being present on the outer surface of the membrane formed by the seal in the twisted state.

The invention has been described above in reference to embodiments provided purely as examples. It is of course not limited to these embodiments, but encompasses all embodiments covered by the appended claims.

What is claimed is:

1. A container for food use comprising:

a container body forming an opening, a moving ring capable of pivoting relative to the container body, between a releasing position freeing the opening and a closing position closing off the opening, and a seal made from a flexible resilient material, connected to said container body on a first side and to said moving ring on a second side, the seal is able to be twisted by pivoting the moving ring relative to the body between said releasing and closing positions, a deformation of the seal occurring between a non-twisted state, in which the seal frees the opening of the container, and a twisted state, in which said seal closes off that opening;

said body comprises a circular peripheral wall ending with a free edge that delimits said opening, and said ring is designed to be engaged around that wall;

one from among said peripheral wall and said ring comprises:

an oblique groove, a first end of which is situated at a first axial distance from said opening and a second end of which is situated at a second axial distance from said opening;

a circumferential groove, one end of which communicates with said second end of said oblique groove; and a plurality of notches formed along said circumferential groove, laterally relative to said groove and communicating therewith;

the other from among said peripheral wall and said ring comprises a lug capable of being engaged and sliding in said oblique groove and in said circumferential groove, and capable of partially engaging in one or the other of said notches of said plurality of notches, said oblique groove being positioned such that the movement of said lug therein produces an axial movement of the ring in the direction bringing the ring and said opening axially closer together during a first part of the movement of the ring from said released position to said closing off position, and, conversely, such that said movement produces an axial movement of the ring in the axial separation direction of the ring and said opening during a second part of the movement of the ring from said closing off position to said released position, at least a first of said notches being angularly positioned so as to receive said lug when the seal is in a partial twisted state, and a second of said notches being positioned angularly so as to receive said lug when the seal is in a complete twisted state.

2. The container according to claim 1, wherein the container comprises two angularly opposite lugs and two sets of grooves, angularly opposite in a corresponding manner.

3. The container according to claim 2, wherein the container body comprises a first lug and a first set of grooves as previously cited, while the ring comprises a second set of grooves, designed to receive said first lug, as well as a second lug designed to be engaged in said first set of grooves.

4. The container according to claim 1, wherein the circumferential groove comprises at least two notches positioned angularly so as to receive said lug when the seal is in a partially twisted state, namely:

one notch located in a position corresponding to a half-sealing of the opening of the container, allowing a sufficient opening to remain so as to allow a product contained in the container to be cooked;

at least one notch positioned on the side of the notch corresponding to the completely sealed position of the opening, allowing an opening to remain just sufficient for the passage of a beverage straw.

5. The container according to claim 2, wherein each set of grooves comprises an inlet, emerging at the free edge of the peripheral wall or a free edge of the ring, communicating with said first end of said oblique groove.

6. The container according to claim 5, wherein each set of grooves comprises a step, or other type of hard spot, between said oblique groove and said inlet, which must be crossed by the lug to go from said oblique groove to said inlet.

7. The container according to claim 6, wherein said inlet has a width that increases toward said free edge.

8. The container according claim 5, wherein each set of grooves further comprises:

an intermediate groove, situated between said oblique groove and said inlet, communicating with each of the latter; and a groove for disengagement of the ring with respect to the container body, communicating with that intermediate groove and which emerges in said free edge.

9. The container according to claim 8, wherein said intermediate groove communicates with that disengaging groove by a step, or other type of hard spot, that must be crossed by the lug to go from said intermediate groove to said disengaging groove.

10. The container according to claim 1, wherein said peripheral wall comprises wide openings providing access to the outer surface of the seal.

* * * * *